US008920638B2

(12) United States Patent
Petcavich

(10) Patent No.: US 8,920,638 B2
(45) Date of Patent: Dec. 30, 2014

(54) METHOD OF SEPARATING HYDROCARBONS FROM OIL ROCKS USING IONIC LIQUIDS

(76) Inventor: Robert Petcavich, The Woodlands, TX (US)

( * ) Notice: Subject to any disclaimer, the term of this patent is extended or adjusted under 35 U.S.C. 154(b) by 917 days.

(21) Appl. No.: 12/941,188

(22) Filed: Nov. 8, 2010

(65) Prior Publication Data

US 2011/0108466 A1 May 12, 2011

Related U.S. Application Data

(60) Provisional application No. 61/280,989, filed on Nov. 12, 2009.

(51) Int. Cl.
*C10G 1/04* (2006.01)
*C10G 1/00* (2006.01)

(52) U.S. Cl.
CPC ... *C10G 1/04* (2013.01); *C10G 1/00* (2013.01)
USPC ..... 208/402; 208/390; 166/303; 166/304; 166/305.1

(58) Field of Classification Search
CPC ..... C10G 1/00; C10G 1/04; H05B 2214/03
USPC ..... 208/390, 391, 400–435; 166/303, 304, 166/305.1, 306
See application file for complete search history.

(56) References Cited

U.S. PATENT DOCUMENTS 4,068,716 A * 1/1978 Allen ..... 166/271
4,419,214 A * 12/1983 Balint et al. ..... 208/402
2006/0076273 A1* 4/2006 Cobb ..... 208/390
2009/0145806 A1* 6/2009 Hamad ..... 208/142
2011/0042318 A1* 2/2011 Painter et al. ..... 210/664

FOREIGN PATENT DOCUMENTS

WO WO03020843 * 3/2003

OTHER PUBLICATIONS

Paten, et al., The Dissolution of Kerogens in Ionic Liquids, Green Industrial Applications of Ionic Liquids, Ed. Rogers, et al., Nato Science Series, Kluwe Academic Publishers, p. 499-510 (2002).*

Keith Johnson, What's an Ionic Liquid?, The Electrochemical Society Interface, vol. 16, No. 1, p. 38-41 (Spring 2007).*

Painter, et al., Recovery of Bitumen from Oil or Tar Sands Using Ionic Liquids, Energy Fuels 2010, vol. 24, p. 1094-1098 (Published on Web Oct. 7, 2009).*

A.C. Metaxas, Microwave Heating, Power Engineering Journal, p. 237-247 (Sep. 1991).*

* cited by examiner

*Primary Examiner* — Prem C Singh
*Assistant Examiner* — Brandi M Doyle
(74) *Attorney, Agent, or Firm* — Greer, Burns & Crain, Ltd.

(57) ABSTRACT

A method of extracting hydrocarbon from oil containing rocks is herein disclosed. According to one embodiment a method includes mixing oil sandstone and a phosphonium based ionic liquid and subjecting the resulting mixture to microwave radiation of 2.54 Gigahertz. Within 1 minute the trapped hydrocarbon is extracted into the ionic liquid which can be subsequently processed to remove the hydrocarbons from the ionic liquid.

18 Claims, 3 Drawing Sheets

METHOD OF SEPARATING HYDROCARBONS FROM OIL ROCKS USING IONIC LIQUIDS

FIELD OF THE INVENTION

The present invention discloses the use of ionic liquids for the extraction of oil hydrocarbons from rock sources. More particularly the present application is directed to heating ionic liquids with electromagnetic radiation, then separating hydrocarbons from the oil rock using the energized ionic liquids.

BACKGROUND OF THE INVENTION

Oil rock and sands contain a significant amount of the world's known oil deposits, possibly one half or more of the proven reserves. Oil is usually extracted from these sources by several techniques, such as in situ production where heat, hot water and pressure are applied to fracture the rock to release the oil. In the case of sands, the sands are open pit mined and subsequently recovered using copious amounts of water. Natural gas is burned to heat the sand and water treatments. In both of the above mentioned examples, the extraction techniques are environmentally damaging, and in the oil sands example, result in a significant amount of carbon dioxide generation. In addition, the water used to extract the hydrocarbons ends up being a mixture of oil extracts, caustic chemicals, and particulates that is extremely toxic to wildlife. In addition to the aforementioned processes, organic solvents are used to reduce the viscosity of the recovered oil hydrocarbons in order to be able to ship the resulting product via pipelines. The organic solvents are expensive, flammable, often toxic to living organisms, and potentially industrially hazardous.

Large oil sand and rock deposits exist in Canada, the United States and Venezuela. Approximately 20% of the Canadian deposits are recoverable using open pit mining techniques, whereas the remaining 80% is too deep for open pit mining. The Venezuela deposits are too deep for open pit mining and the Utah deposits are in areas that are not accessible to large amounts of fresh water which would make extraction economically feasible. Therefore it is the intent of the present invention to solve the problems of environmental destruction, and lack of water for in situ hydrocarbon extraction of deep deposits, by the use of environmentally safe ionic liquids in combination with electromagnetic radiation.

Another object of this invention is to provide a method of extraction oil from various rock sources by using an environmentally safe ionic liquid that eliminates the use of water and conventional organic solvents.

Another object of the present invention is to provide a method of in situ production of oil hydrocarbons from rock sources using ionic liquids and electromagnetic radiation to accelerate the extraction process.

The foregoing and other objects, features and advantages of the present invention will become more apparent to one skilled in the art from the following detailed description of the exemplary embodiments as disclosed herein.

BRIEF SUMMARY OF THE INVENTION

At least one of the foregoing objects is met by a method of heating an ionic liquid using electromagnetic energy and using the ionic liquid for extracting hydrocarbons from oil rock. According to one embodiment oil rock and ionic liquid are combined and subjected to microwave energy for a sufficient time to heat the ionic liquid. Heating of the ionic liquid allows it to readily hydrocarbons from the oil rock. The product hydrocarbon-containing liquid can be subsequently separated into hydrocarbons and used ionic liquid. The hydrocarbon is then optionally refined into petroleum products. The used ionic liquid is optionally reused by recycling it to the start of the process for extraction of hydrocarbon from more rock.

The combination of the ionic liquid and the microwave energy produces a high energy liquid that effectively removes hydrocarbon from oil rocks. Good recovery of hydrocarbon is achieved at 50° C., compared to steam injection. Far less energy is needed to heat the ionic liquid to 50° C. than to heat water to 100° C. plus the energy needed for the phase change to steam.

DETAILED DESCRIPTION OF THE INVENTION

Figure 1:
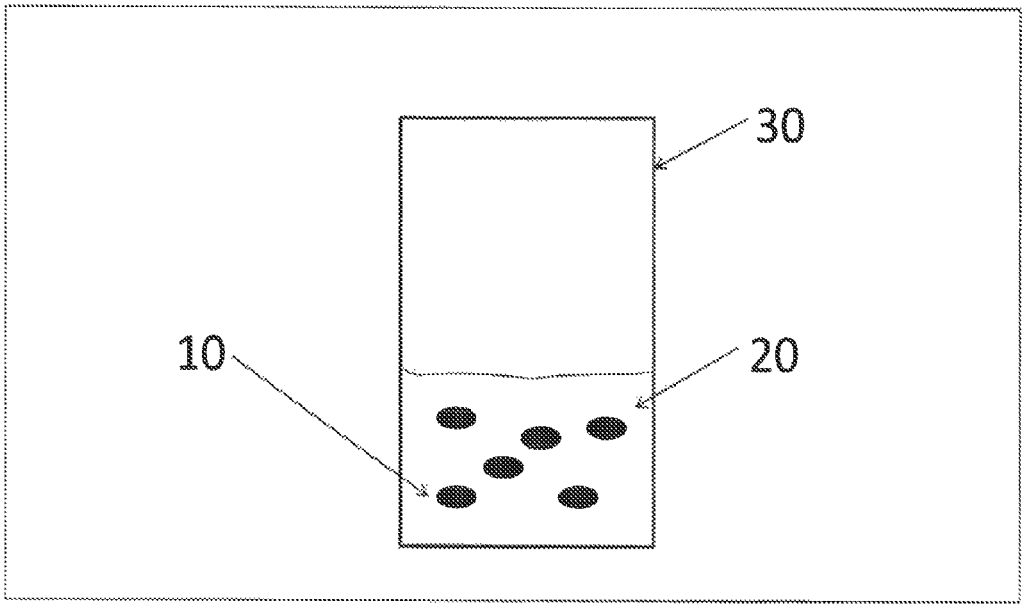
FIG. 1 illustrates an exemplary system for recovering hydrocarbons from oil rock according to one embodiment of the present invention.
Figure 2:
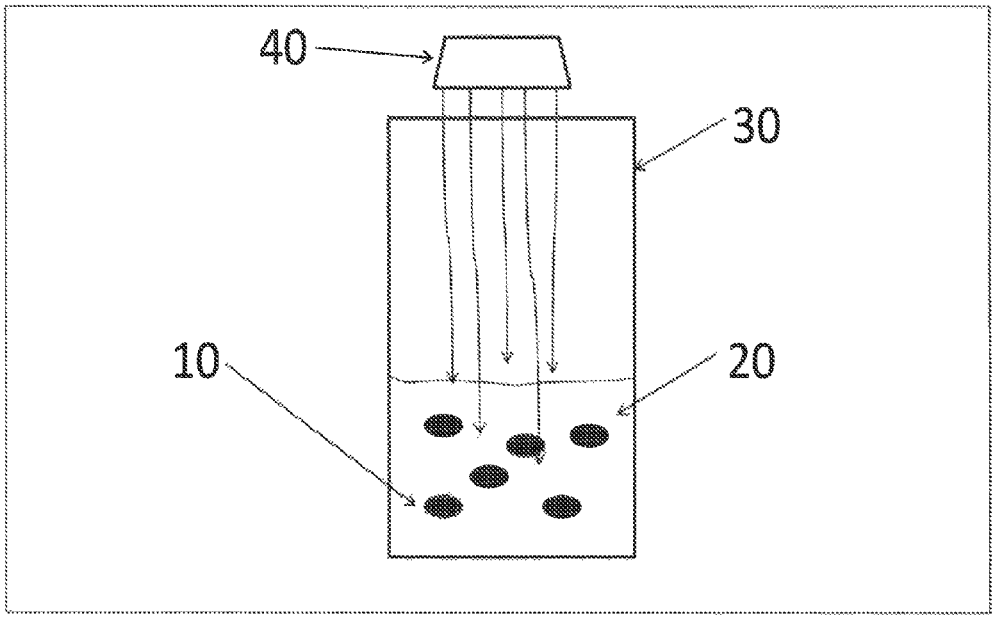
FIG. 2 illustrates extraction of hydrocarbon from oil sandstone in the exemplary system of FIG. 1 using an ionic liquid and a microwave radiation source.
Figure 3:
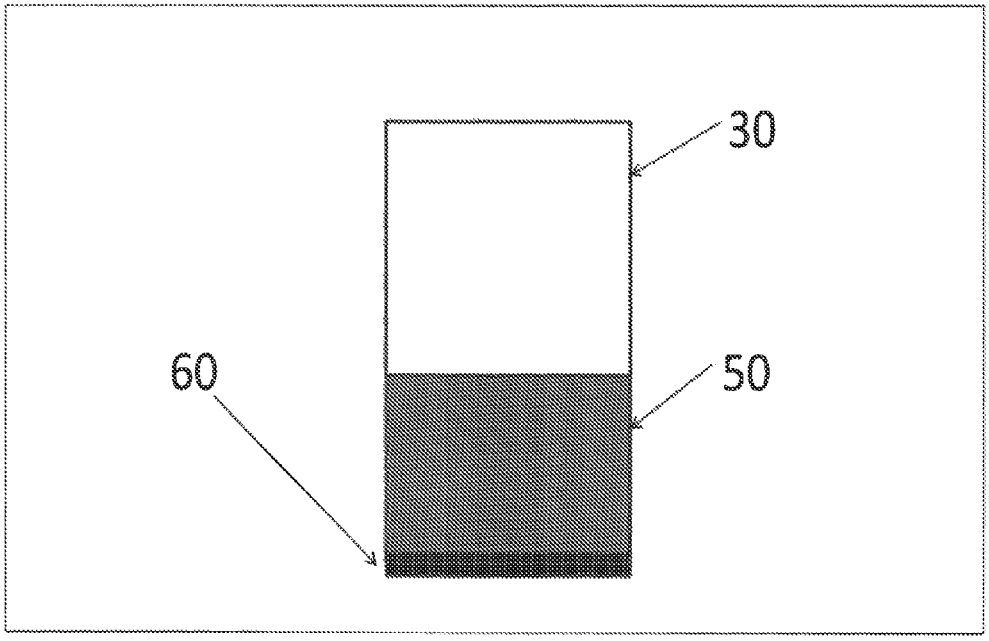
FIG. 3 illustrates the results of the oil rock extraction process in the exemplary system of FIG. 1 after electromagnetic radiation exposure.

FIG. 1 illustrates an exemplary system for recovering hydrocarbons from oil rock 10 according to one embodiment. Oil rock 10 includes, but is not limited to oil-bearing shale, sandstone, limestone, dolostone and sands resulting from erosion of the aforementioned rocks. The oil rock 10 is mixed with ionic liquid 20 in a containment vessel 30. FIG. 2 shows the mixture as in FIG. 1, exposed to a microwave radiation source 40 for a predetermined period of time that accelerates the hydrocarbon extraction process from the oil rock. After exposure, the mixture is agitated and a brown liquor of ionic liquid and extracted hydrocarbon 50 results with un-dissolved rock 60 settling on the bottom of the containment vessel as shown in FIG. 3. The ionic liquid/hydrocarbon solution can then be further separated and refined using techniques well known in the art for refining oil products. The ionic liquid is optionally recycled.

The ionic liquid used in the present invention can be polar or non polar in nature and are preferably liquid at or near room temperature (about 20° C.). Ionic liquids are ionic salts that are in a liquid state. A pure ionic liquid is a salt that melts to form a liquid without decomposing. Some ionic liquids are ionic solutions containing the liquid salt and neutral molecules, such as water. For the purposes of this application, the term "ionic liquid" is intended to include both pure ionic liquids and ionic solutions. They have appealing solvent properties and are miscible with water or organic solvents. Ionic liquids are electrical conductors due to their ionic nature. The electrical resistance of the ionic liquid is from about 1Ω to about 10,000Ω, with preferred embodiments having a resistance between 100Ω and 400Ω.

Ammonium-, imidazolium-, phosphonium-, pyridinium-, pyrrolidinium-, and sulfonium-based ionic liquids are commercially available. Two types of ionic liquids are particularly useful in the present process, those having a phosphonium functional group and liquids having an imidazolium group. While the exact mechanism is unknown, the hydrocarbon does not appear to fully dissolve in the ionic liquid.

Depending on the ionic liquid selected, there are varying degrees of miscibility of the hydrocarbon. Where the ionic liquid is recycled, as described below, in preferred embodiments the ionic liquid is selected for ease in separation of the hydrocarbon and ionic liquid.

Examples of ionic liquids that are known to be useful include 1-Butyl-3-methylimidazolium tetrachloroaluminate, 1-Ethyl-3-methylimidazolium acetate, 1-Butyl-3-methylimidazolium acetate, 1-Butyl-3-methylimidazolium methylsulfate, 1-Butyl-3-methylimidazolium thiocyanate, 1-Butyl-3-methylimidazoliumbistrifluoromethanesulfonylimide, 1-Ethyl-3-methylimidazoliumbistrifluoromethanesulfonylimide, 1-Ethyl-3-methylimidazolium ethylsulfate, 1-Ethyl-3-methylimidazolium thiocyanate, Trihexyltetradecyl phosphonium chloride, Trihexyltetradecyl phosphonium bromide, Tetradecyltrihexylphosphonium Bis-2,4,4, triethylpentyl phosphinate, Tetradecyltrihexyl phosphonium dicyanamide, Tetradecyltrihexyl phosphonium bistriflamide, Ethyltributylphosphonium diethylphosphate, Tetradecyltributylphosphonium docecylbenzene sulfonate, Tetradecyltrihexylphosphonium docecylbenzenesulfonate, Tetraoctylphosphonium bistriflamide, Tetraoctylphosphonium bistriflamide, Tributyltetradecylphosphonium bistriflamide, Tetrabutyl Phosphonium Glycolate, Tributylmethylphosphonium bistriflamide, Triethylpentyl phosphonium bistriflamide, Tetrabutyl phosphonium tridecylsulfosuccinate and Trihexyl tetradecyl phosphonium tridecylsulfosuccinate. Use of combinations of the ionic liquids is also contemplated.

When combining the oil rock with the ionic liquid, any amounts of ionic liquid and oil rock may be used. Ratios of ionic liquid to oil rock of about 1:1 to about 9:1 based on weight are used in some embodiments. In other embodiments, ratios of 3:2 to about 2:3 based on weight are employed. Exact ratios of oil rock to ionic liquid depend on several factors. When high quality oil rock is mined, that is oil rock with a high proportion of hydrocarbons, a larger amount of ionic liquid is needed to dissolve the hydrocarbons. Another factor that influences the ratio of ionic liquid to oil rock is the pumpability of the liquid. As less ionic liquid is employed, it becomes more viscous as it accumulates hydrocarbons and becomes difficult to pump. When pump limitations become problematic, an increase in the relative amount of the ionic liquid helps to maintain a good fluid viscosity.

Optionally, the oil rock is allowed to soak in the ionic liquid after the two ingredients are combined. The soaking step allows the ionic liquid to penetrate the rock to some degree. When the electromagnetic radiation is applied, the ionic liquid is able to solubilized hydrocarbons from deeper within the rock, making it more effective. Depending on the temperatures reached, having the ionic liquid in cracks or fissures of the oil rock also has the potential for the fluid to expand and fracture the rock. The presence of larger fractures in the oil rock allows the ionic fluid to get even deeper into the rock, freeing more of the hydrocarbons.

Electromagnetic radiation is used to heat the ionic liquid only or a mixture of the ionic liquid and oil rocks. If extraction of the hydrocarbon is carried out in situ while the rock is in place, the ionic liquid is directly heated by the electromagnetic radiation. After heating the ionic liquid, it is pumped underground to the formation of oil-bearing rock. Preferably, the ionic liquid is exposed to the electromagnetic radiation in a pipe as it moves toward the formation of oil rock. Pressure from the pump pushes the liquid through the rock strata where the hydrocarbon is collected by the ionic liquid. The ionic liquid/hydrocarbon mixture is then pumped to the surface from an underground collection point.

In cases where the oil rock is removed from its natural formation, the rock is optionally broken or ground to a manageable size and placed in a vessel for extraction. In these embodiments, both the rock and the ionic liquid are optionally heated electromagnetically.

The electromagnetic radiation used in the present invention is in the form of microwaves or infrared radiation. In the present invention, 2.54 GHz microwave radiation is used in some embodiments due to its ubiquitous availability and low cost. Microwaves in the range of 125 MHz to 5.6 GHz are contemplated for heating the ionic liquid. In some embodiments, the microwave frequency is selected from the range of about 900 MHz to about 2.45 GHz. When the ionic liquid is exposed to the microwaves in a pipe for an in situ extraction, heating is most efficient when the entire wavelength of the microwave is contained within the diameter of the pipe. If, for example, a 12 inch pipe is used, the microwave frequency should be no less than 915 MHz. Infrared sources may also be used, such as radiant heaters or black body emitters, to raise the temperature of the ionic liquid oil rock mixture to improve solubility of the trapped, adsorbed or absorbed hydrocarbon. Since the ionic liquids are low vapor pressure and non flammable by nature at atmospheric conditions, these heating techniques are industrially safe and environmentally benign for use in open pit and in situ extraction of oil rock trapped hydrocarbons.

Radiation is applied to the mixture of the ionic liquid and oil rock until it reaches a temperature of at least 20° C. In some embodiments, heating continues until the temperature is between about 20° C. and 100° C. Other embodiments target a liquid temperature of about 20° C. to about 50° C. The temperature of the ionic liquid should be sufficient for efficient extraction of the hydrocarbons. The exact temperature needed to free the oil from the rock will depend on the quality and quantity of the hydrocarbons within the oil rock. As the average molecular weight of the hydrocarbon increases, higher temperatures are needed to liquefy them. Even if the ionic liquid is already at a temperature above 20° C., it is exposed to the electromagnetic energy anyway. The electromagnetic energy, such as microwaves, imparts different type of energy to the ionic liquid than thermal energy. It has been theorized, but not proven, that perhaps an excitation or rotation is imparted to the ions or the molecules. The combination of the ionic liquid and the microwave energy produces better results than conventional steam injection.

The time required for the energy source to heat the ionic liquid primarily depends on the temperature that needs to be achieved. For a given microwave or IR source, the exposure time is directly proportional to the mass being heated and the available power. Of course, the exposure time can be reduced by replacing the microwave or IR source with a higher energy unit. It should be clear to an artisan that the power of the energy source, microwave or IR and the mass being heated are variable to balance the factors of unit throughput and cost. After the hydrocarbon has been extracted from the oil rocks, the hydrocarbon is separated from the used ionic liquid. Any known method of separating two liquids can be employed, but in preferred embodiments, the hydrocarbon is separated from used ionic liquid by density. As discussed above, the ionic liquid is optionally selected to ease separation of the two fluids. For example, hydrocarbons such as those recovered from oil rocks often have a specific gravity of about 0.95, while some ionic liquids have a specific gravity of about 1.5. As long as the hydrocarbon has low miscibility in the ionic liquid, the liquid recovered from the extraction will separate into two layers, with the hydrocarbon layer on top. A centrifuge is useful, if necessary, to hasten the separation or increase the hydrocarbon recovery. The used ionic liquid is then optionally recycled to be recontacted with additional oil rocks for further extraction of hydrocarbons. It is contemplated that the used ionic liquid can be reused either alone or in combination with fresh ionic liquid.

EXAMPLES

The following examples are provided to illustrate the exemplary methods for extracting hydrocarbon for oil stones. Oil stone was purchased from the ONTA Corporation and oil sands from the Alberta Research Council with 13% by weight of trapped oil and used in the following examples.

Example 1

10 grams of oil sandstone obtained from the ONTA Corporation of Canada was placed into a 350 milliliter (ml) beaker with 20 milliliters of CYPHOS 109 ionic liquid, which is (trihexyl)tetradecylphosphonium bis(trifluoromethylsulfonyl)imide from the Cytec Industries, Inc., Woodland Park, N.J. The sample mixture was allowed to stand for 12 hours at room temperature. The mixture showed no signs of the trapped hydrocarbons being dissolved into the ionic liquid. The oil sandstone was black in color and the ionic liquid was clear.

Example 2

The sample as in 1 was placed in a home microwave oven that operates at 2.54 GHz and was heated for 30 seconds. The ionic liquid reached a temperature of 85° C. The solution was allowed to stand for 1 hour and observed. There was no significant color change in the oil sandstone ionic liquid mixture. This would indicate no dissolution of the trapped hydrocarbon in the oil rock.

Example 3

10 grams of oil shale rock and 20 mls of CYPHOS 109 as in example 1 were placed into a beaker and allowed to stand for 12 hours at room temperature. After 12 hours there was a noticeable color change in the mixture to a brown black color which would indicate hydrocarbon extraction from the oil shale rock.

Example 4

The sample as in example 3 was heated in a home microwave oven for 30 seconds and allowed to cool for 1 hour. The mixture had a brown black color which would indicate hydrocarbon extraction from the oil shale.

Example 5

10 grams of oil sandstone and 20 mls of CYPHOS 105, trihexyl(tetradecyl)phosphonium dicyanamide from the Cytec Industries, Inc., were placed into a beaker and allowed to stand at room temperature for 12 hours. After 12 hours there was no noticeable change in color of the oil sandstone ionic liquid mixture. This would indicate no extraction of the trapped hydrocarbons from the oil sandstone.

Example 6

The sample as in example 5 was placed into a home microwave oven and heated for 30 seconds. The mixture reached a temperature of 85° C. and was allowed to sit for 1 hour. There was a significant change in color in the ionic liquid to a deep brown color and the physical size of the oil stone went from pea size to a granular powder. This observation would indicate that the trapped hydrocarbon dissolved into the ionic liquid.

Example 7

20 grams of oil sand obtained from the Alberta Research Council was placed into a beaker with 40 mls of CYPHOS 105 and allowed to sit at room temperature for 12 hours. After 12 hours there was very slight change in color to a light straw or yellow of the oil sand, ionic liquid mixture. This would indicate little or no extraction of the trapped hydrocarbons from the oil sand.

Example 8

The sample as in example 7 was placed into a home microwave oven and heated for 30 seconds. The mixture reached a temperature of 85° C. There was a significant change in color in the ionic liquid to a deep brown black color and the agglomerated sand settled as a granular powder on the bottom of the glass beaker. This observation would indicate that the trapped hydrocarbon was extracted and dissolved into the ionic liquid.

Example 9

A 3 barrel per hour continuous extraction microwave system was set up at Industrial Microwave Systems in Cary, N.C. A mixture of 5 pounds of Canadian Oil sands and 15 pounds by weight of a water-based ionic liquid called BLUE GOLD™ (Sodium Xylene Sulfate 5%; Nonylphenol Ethoxalate 4%; Sodium Tripolyphosphate 2%; Diethylene Glycol Butyl Ether 9%; Sodium Hydroxide 5%; Water 75%) manufactured by Modern Chemical of Jacksonville Ark. was mixed into a slurry at room temperature and fed into a hopper and pumped into a continuous closed loop 915 Megahertz microwave heating system. The electrical resistivity of the water based ionic liquid was approximately 120 ohms. At a rate of 3 barrels per hour the slurry was heated from 20° C. to 50° C. within 2 seconds and the bitumen was extracted from the sand. The mass energy calculations of the process showed that it takes 72 kilowatts of energy to extract 3.38 barrels of oil from the sand which is approximately 80% less energy needed to extract the oil versus the standard steam based processes in use today.

The invention herein is described by examples and a particularly desired way of practicing the invention has been described. However, the invention as claimed herein is not limited to that specific description in any manner. Elements and features described in conjunction with a particular embodiment are not limited to use therewith and may be used separately or in conjunction with the other embodiments disclosed herein. Equivalence to the description as hereinafter claimed is considered to be within the scope of protection of this patent. While particular embodiments of the method for extracting hydrocarbons have been shown and described, it will be appreciated by those skilled in the art that changes and modifications may be made thereto without departing from the invention in its broader aspects and as set forth in the following claims.

What is claimed is:

1. A method of extracting hydrocarbons from oil rocks comprising:

preparing a mixture of a water-based ionic liquid and one or more oil rocks, wherein the water-based ionic liquid comprises Sodium Xylene Sulfate; Nonylphenol Ethoxalate; Sodium Tripolyphosphate; Diethylene Glycol Butyl Ether; Sodium Hydroxide; and water;

subjecting the mixture to electromagnetic radiation under the atmospheric pressure; and extracting hydrocarbons from the one or more oil rocks.

2. The method as in claim 1 where the mixture of said preparing step is subjected to sufficient microwave electromagnetic radiation so that the temperature of the mixture is raised to above 20° C. during said subjecting step.

3. The method as in claim 1 where said subjecting step further comprises deriving the electromagnetic radiation from a microwave generator, a radiant heater or a black body emitter.

4. The method as in claim 1 where the oil rocks are selected from the group consisting of shale, sandstone, limestone, dolostone, combinations thereof and sands of the aforementioned rocks.

5. The method as in claim 1 further comprising separating used water-based ionic liquid from the extracted hydrocarbon and recycling the used water-based ionic liquid.

6. The method as in claim 5 wherein said recycling step further comprises blending the used water-based ionic liquid with fresh water-based ionic liquid.

7. The method as in claim 1 wherein the water-based ionic liquid and the oil rocks are present in a ratio of about 1:1 to about 9:1, based on weight.

8. The method as in claim 2 where the microwave electromagnetic radiation is microwave energy in the range of about 900 MHz to about 2.54 GHz.

9. The method as in claim 1 where the water-based ionic liquid is selected to have a resistance of about 1Ω to about 10,000Ω.

10. A method of extracting hydrocarbons from oil rocks, comprising:

subjecting a water-based ionic liquid to electromagnetic radiation to heat it above 20° C., wherein the water-based ionic liquid comprises Sodium Xylene Sulfate; Nonylphenol Ethoxalate; Sodium Tripolyphosphate; Diethylene Glycol Butyl Ether; Sodium Hydroxide; and water;

contacting oil rocks with the heated ionic liquid in situ; and extracting hydrocarbons from the oil rocks.

11. The method as in claim 10 where said subjecting step further comprises deriving the electromagnetic radiation from a microwave generator, a radiant heater or a black body emitter.

12. The method as in claim 10 where the oil rocks are selected from the group consisting of shale, sandstone, limestone, dolostone, combinations thereof and sands of the aforementioned rocks.

13. The method as in claim 10 further comprising separating used water-based ionic liquid from the extracted hydrocarbon and recycling the used water-based ionic liquid.

14. The method as in claim 10 wherein said recycling step further comprises blending the used water-based ionic liquid with fresh water-based ionic liquid.

15. The method as in claim 10 wherein the ionic liquid and the oil rocks are present in a ratio of about 1:1 to about 9:1, based on weight.

16. The method as in claim 10 where the water-based ionic liquid is selected to have a resistance of about 1Ω to about 10,000Ω.

17. The method as in claim 10 where electromagnetic radiation is microwave electromagnetic radiation.

18. The method as in claim 17 where the microwave electromagnetic radiation is microwave energy in the range of about 900 MHz to about 2.54 GHz.

* * * * *